US011850856B2

(12) United States Patent
Kanzaki

(10) Patent No.: US 11,850,856 B2
(45) Date of Patent: Dec. 26, 2023

(54) LIQUID DISCHARGE HEAD

(71) Applicant: Brother Kogyo Kabushiki Kaisha, Nagoya (JP)

(72) Inventor: Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 64 days.

(21) Appl. No.: 17/558,913

(22) Filed: Dec. 22, 2021

(65) Prior Publication Data

US 2022/0258469 A1 Aug. 18, 2022

(30) Foreign Application Priority Data

Feb. 15, 2021 (JP) ..... 2021-021925

(51) Int. Cl.
*B41J 2/14* (2006.01)

(52) U.S. Cl.
CPC .. *B41J 2/14233* (2013.01); *B41J 2002/14419* (2013.01)

(58) Field of Classification Search
CPC ..... B41J 2/14233; B41J 2002/14419; B41J 2002/14306; B41J 2202/12
See application file for complete search history.

(56) References Cited

U.S. PATENT DOCUMENTS 11,040,534 B2 6/2021 Miyagishi
2020/0207090 A1* 7/2020 Miyagishi ..... B41J 2/14145
2020/0391509 A1* 12/2020 Katayama ..... B41J 2/14209

FOREIGN PATENT DOCUMENTS

JP 2020-104364 A 7/2020

* cited by examiner

*Primary Examiner* — Lisa Solomon
(74) *Attorney, Agent, or Firm* — Banner & Witcoff, Ltd.

(57) ABSTRACT

There is provided a liquid discharge head comprising a channel-forming body. The channel-forming body includes a nozzle surface in which a plurality of nozzles arranged in a line open. The channel-forming body has formed therein a supply manifold, a return manifold, and a plurality of individual channels. Each individual channel includes a pressure chamber, a descender, a return throttling path, and an interposing channel that interposes between the return throttling path and the descender and communicates with the nozzle. The return throttling path extends in a second direction differing from a first direction in which the interposing channel extends. A cross-sectional area of the return throttling path is smaller than a cross-sectional area of the interposing channel.

9 Claims, 5 Drawing Sheets

LIQUID DISCHARGE HEAD

CROSS REFERENCE TO RELATED APPLICATIONS

The present application claims priority from Japanese Patent Application No. 2021-021925, filed on Feb. 15, 2021, the disclosure of which is incorporated herein by reference in its entirety.

BACKGROUND

There is known a liquid discharge head that includes a supply manifold and a return manifold, and is configured to allow an ink to be circulated between an ink tank and the liquid discharge head. There is publicly known a liquid discharge head that, in order for a bubble in a nozzle vicinity to be effectively removed, is provided with a first portion that creates a flow from a direction perpendicular to an axial center of the nozzle.

SUMMARY

However, in the above-described liquid discharge head, there has been a problem of it being impossible to sufficiently secure a length of a return throttling path connected to a downstream side of the above-described first portion. Therefore, there has been a risk of it being impossible for a required pressure loss to be secured, and of it thus being impossible for pressure at discharge time to be effectively applied to the nozzle.

Accordingly, the present disclosure has an object of providing a liquid discharge head by which a required pressure loss becomes more easily secured.

According to an aspect of the present disclosure, there is provided a liquid discharge head including a channel-forming body. The channel-forming body includes a nozzle surface in which a plurality of nozzles is arranged in an array direction. The channel-forming body includes: a supply manifold, a return manifold and a plurality of individual channels. The supply manifold is configured that a liquid is supplied from outside. The return manifold is configured that the liquid is discharged to outside. Upstream ends of the plurality of individual channels are communicated with the supply manifold. Downstream ends of the plurality of individual channels are communicated with the return manifold. The plurality of individual channels are communicated with the plurality of nozzles, respectively. Each of the plurality of individual channels includes: a pressure chamber, a descender being communicated with the pressure chamber, a return throttling path being communicated with the return manifold, and an interposing channel interposing between the return throttling path and descender and being communicated with the nozzle. The return throttling path extends in a second direction different from a first direction in which the interposing channel extends. A cross-sectional area of the return throttling path is smaller than a cross-sectional area of the interposing channel.

In the above-described liquid discharge head, the return throttling path extends in the second direction differing from the first direction. Therefore, a longer length of the return throttling path is able to be secured than in a conventional aspect where the return throttling path extends in the same direction as an extension direction of the interposing channel. Moreover, a bending loss can be generated in a connecting portion of the interposing channel and the return throttling path. Furthermore, the cross-sectional area of the return throttling path is smaller than the cross-sectional area of the interposing channel. The above result in a required pressure loss becoming more easily secured.

DETAILED DESCRIPTION

A liquid discharge head according to an embodiment of the present disclosure will be described below with reference to the drawings. The liquid discharge head described below is merely one embodiment of the present disclosure. Hence, the present disclosure is not limited to the embodiment below, and may undergo additions, deletions, and changes in a range not departing from the spirit of the present disclosure.

<Configuration of Liquid Discharge Apparatus>

A liquid discharge apparatus 10 including a liquid discharge head 20 according to the present embodiment discharges a liquid such as an ink, for example. Hereafter, there will be described an example where the liquid discharge apparatus 10 has been applied to an ink jet printer. However, a target of application of the liquid discharge apparatus 10 is not limited to an ink jet printer.

Figure 1:
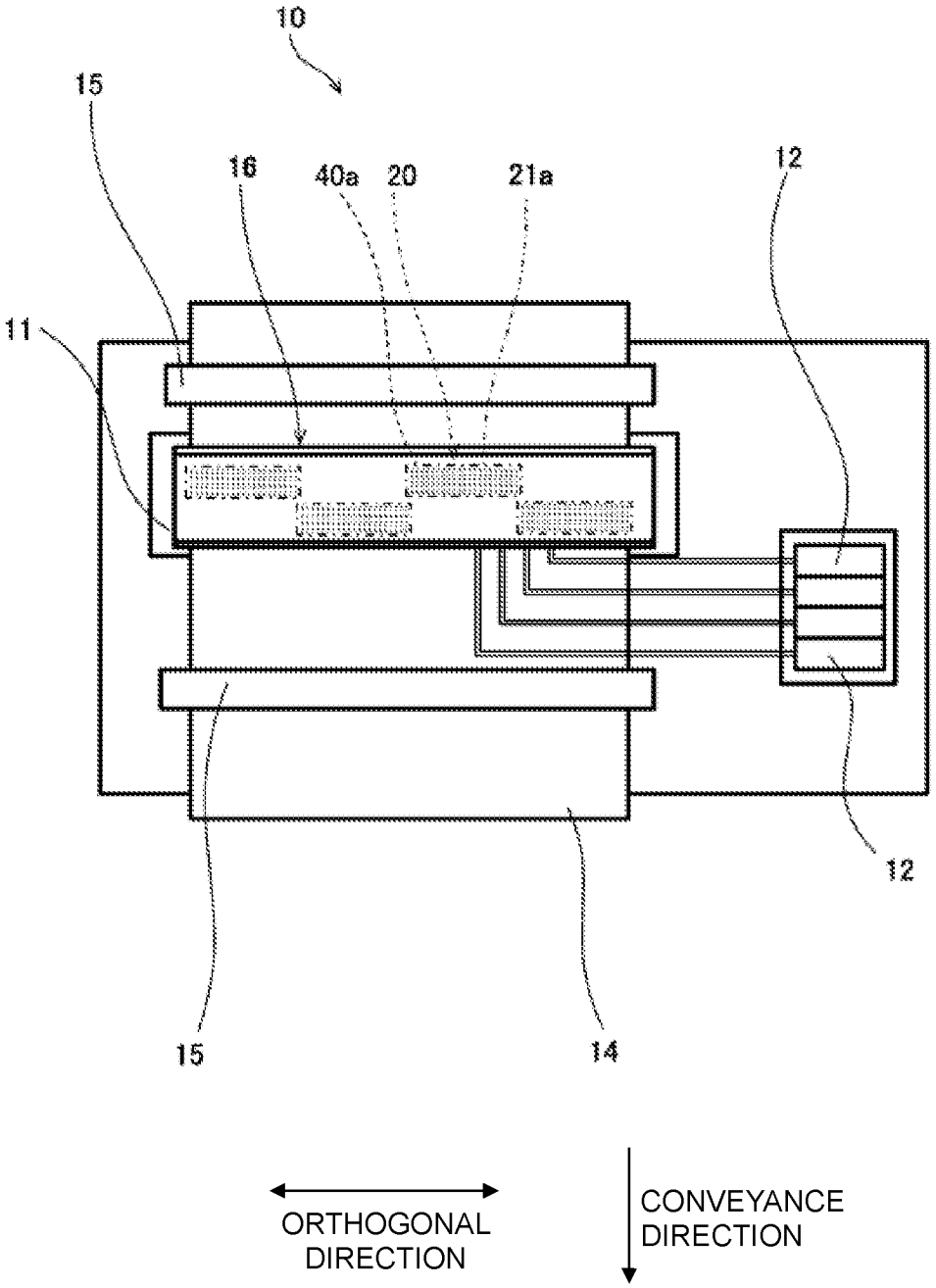
FIG. 1 depicts a plan view showing a schematic configuration of a liquid discharge apparatus including a liquid discharge head.

As depicted in FIG. 1, the liquid discharge apparatus 10, in which there is adopted a line head system, for example, includes a platen 11, a conveyor, a head unit 16, and a tank 12. However, the liquid discharge apparatus 10 is not limited to a line head system, and may also adopt another system, such as a serial head system, for example.

The platen 11, which is a flat plate member, has a paper sheet 14 disposed on its upper surface. The platen 11 plays a role of determining a distance between the paper sheet 14 and the head unit 16. Note that in the following description, more to a head unit 16 side than the platen 11 will be called an upper side, and an opposite side thereto will be called a lower side. However, such a disposition is merely an exemplification, and disposition of the liquid discharge apparatus 10 is not limited to this.

The conveyor has two conveying rollers 15 and an unillustrated conveying motor, for example. The two conveying rollers 15, which are coupled to the above-described conveying motor, are disposed parallel to each other along a direction (an orthogonal direction) orthogonal to a conveying direction of the paper sheet 14 in a state of the platen 11 having been sandwiched them. When the conveying motor is driven, the conveying rollers 15 rotate, and the paper sheet 14 on the platen 11 is conveyed in the conveying direction.

A length in the above-described orthogonal direction of the head unit 16 is not less than a length in the above-described orthogonal direction of the paper sheet 14. The head unit 16 is provided with a plurality of the liquid discharge heads 20.

The liquid discharge head 20 has a laminated body of a channel-forming body 30 and a volume-changing portion. The channel-forming body 30, which has a liquid channel formed on its inside, has a plurality of nozzles 21 opening in its discharge surface (nozzle surface) 40*a*. The volume-changing portion is configured to change volume of the liquid channel. In the case where volume of the liquid channel has been changed, in the nozzle 21, a meniscus vibrates and the liquid is discharged. Note that details of the liquid discharge head 20 will be mentioned later.

In the following description, the case of the liquid being an ink is exemplified. The tank 12 is provided for each kind of said ink. For example, four of the tanks 12 are provided, and the four tanks 12 respectively store therein black, yellow, cyan, and magenta inks. The inks of the tanks 12 are supplied to the corresponding nozzle 21.

<Configuration of Liquid Discharge Head>

Figure 2:
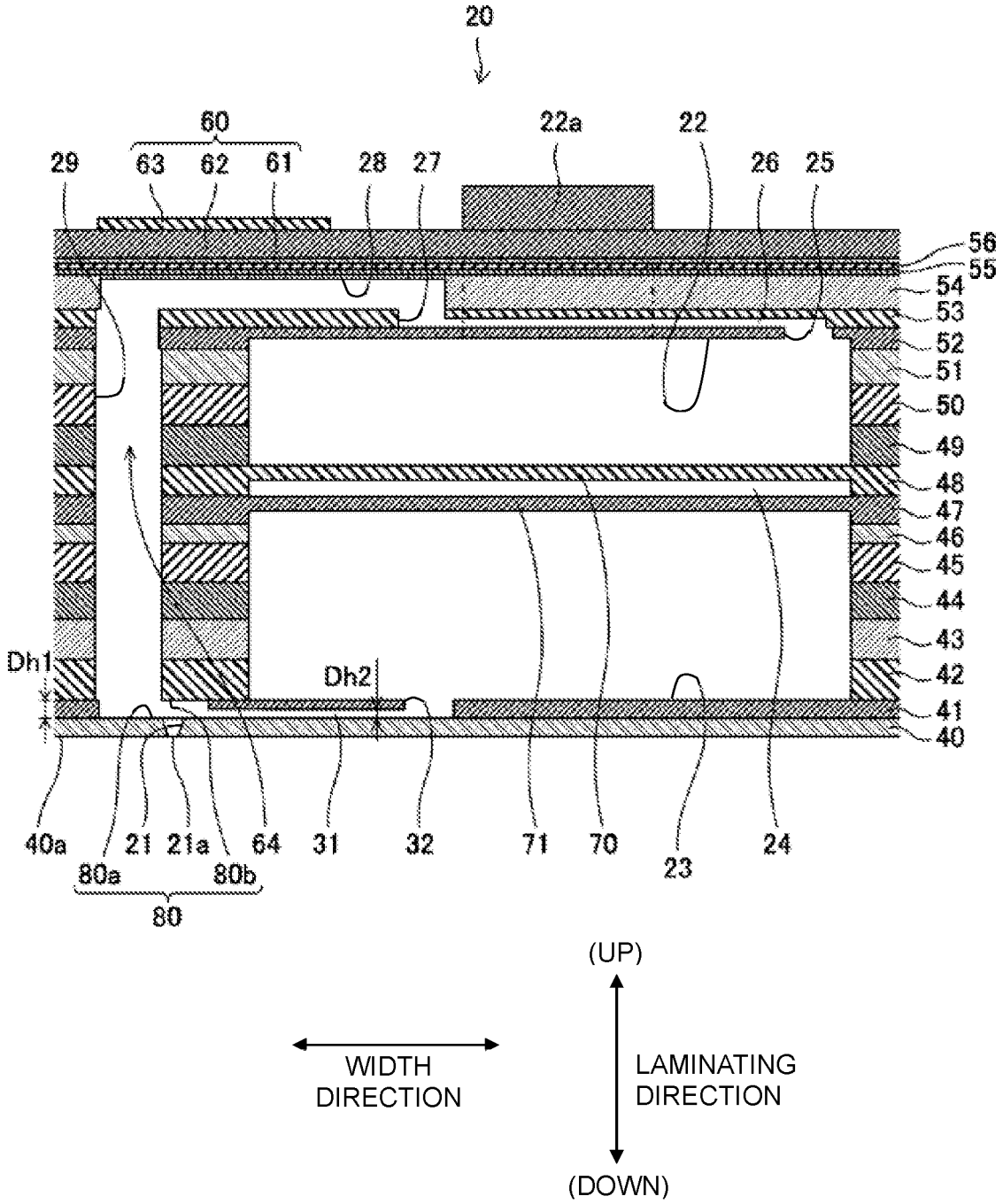
FIG. 2 depicts a cross-sectional view in which the liquid discharge head of FIG. 1 has been cut by a line segment orthogonal to its extension direction.

The liquid discharge head 20 includes the channel-forming body 30 and the volume-changing portion as mentioned above. As depicted in FIG. 2, the above-described channel-forming body 30 is a laminated body of a plurality of plates, and the above-described volume-changing portion has a vibrating plate 55 and a piezoelectric element 60.

The above-described plurality of plates, which are each an etching plate made of a metal, include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a tenth channel plate 50, an eleventh channel plate 51, a twelfth channel plate 52, a thirteenth channel plate 53, and a fourteenth channel plate 54. These plates are laminated in this order.

Each plate has holes and grooves of various sizes formed therein. On an inside of the channel-forming body 30 where each plate has been laminated, the holes and grooves are combined, whereby a plurality of nozzles 21, a plurality of individual channels 64, a supply manifold 22, and a return manifold 23 are formed as a liquid channel.

The nozzles 21 penetrate the nozzle plate 40 in a laminating direction (an up-down direction). In the discharge surface 40*a* of the nozzle plate 40, a plurality of openings 21*a* being tips of the nozzles 21 are aligned in a direction along a nozzle line (hereafter, written as line direction). The line direction is a direction orthogonal to each of the above-described laminating direction and a later-described width direction.

Inertance of the nozzle 21 with respect to the liquid is smaller than inertance of a return throttling path 31 with respect to the liquid. Note that inertance M of a channel with respect to a liquid is expressed by $M=\rho\times L/S$. In this formula for calculation of inertance M, p is density of the liquid, L is channel length, and S is cross-sectional area.

The supply manifold 22 extends in the line direction, and is connected to the plurality of individual channels 64. The return manifold 23 extends in the line direction, and is connected to the plurality of individual channels 64. The supply manifold 22 is disposed above the return manifold 23. The supply manifold 22 communicates with a supply port 22*a*, and the return manifold 23 communicates with an unillustrated return port.

The plurality of individual channels 64 are connected to the supply manifold 22 and the return manifold 23. An upstream end of the individual channel 64 communicates with the supply manifold 22, and its downstream end communicates with the return manifold 23. Moreover, the individual channel 64 communicates with the nozzle 21 in between the supply manifold 22 and the return manifold 23. The individual channel 64 has a first communicating hole 25, a supply throttling path 26, a second communicating hole 27, a pressure chamber 28, a descender 29, an interposing channel 80, the return throttling path 31, and a third communicating hole 32, which are disposed in this order. Note that details of the interposing channel 80 in the present embodiment will be mentioned later.

A lower end of the first communicating hole 25 is connected to an upper end of the supply manifold 22. The first communicating hole 25 extends upwardly in the laminating direction from the supply manifold 22. The first communicating hole 25 penetrates in the laminating direction an upper side portion in the twelfth channel plate 52. The first communicating hole 25 is disposed more to one side (a right side in FIG. 2) than a center in the width direction of the supply manifold 22.

One end of the supply throttling path 26 is connected to an upper end of the first communicating hole 25. The supply throttling path 26 is formed by half-etching processing, for example, so as to become a groove hollowed out from a lower surface of the thirteenth channel plate 53. Moreover, a lower end of the second communicating hole 27 is connected to the other end of the supply throttling path 26. The second communicating hole 27 extends upwardly in the laminating direction from the supply throttling path 26. The second communicating hole 27 penetrates in the laminating direction an upper side portion in the thirteenth channel plate 53. The second communicating hole 27 is disposed more to the other side (a left side in FIG. 2) than the center of the supply manifold 22 in the width direction.

One end of the pressure chamber 28 is connected to an upper end of the second communicating hole 27. The pressure chamber 28 is formed penetrating the fourteenth channel plate 54 in the laminating direction.

The descender 29 penetrates the second through thirteenth channel plates 42-53 in the laminating direction. The descender 29 is disposed more to the other side (the left side in FIG. 2) than the supply manifold 22 and the return manifold 23 in the width direction. An upper end of the descender 29 is connected to the other end of the pressure chamber 28. A lower end of the descender 29 is connected to the interposing channel 80. Note that a cross-sectional area of the descender 29 may be constant in the laminating direction, or may change in the laminating direction.

The interposing channel 80, which penetrates the first channel plate 41 in the laminating direction, is disposed more downwardly than the descender 29. The interposing channel 80 interposes between the descender 29 and the return throttling path 31. Note that details of the interposing channel 80 will be mentioned later.

One end of the return throttling path 31 is connected to a downstream end of a second portion 80*b* of the interposing channel 80. The return throttling path 31 is formed by half-etching processing, for example, so as to become a groove hollowed out from a lower surface of the first channel plate 41.

A lower end of the third communicating hole 32 is connected to the other end of the return throttling path 31. The third communicating hole 32 extends upwardly in the laminating direction from the return throttling path 31. The third communicating hole 32 penetrates in the laminating direction an upper side portion in the first channel plate 41. An upper end of the third communicating hole 32 is connected to a lower end of the return manifold 23. The third communicating hole 32 is disposed more to the other side (the left side in FIG. 2) than a center of the return manifold 23 in the width direction.

The vibrating plate 55, which is laminated on the fourteenth channel plate 54, covers an upper end opening of the pressure chamber 28. Note that the vibrating plate 55 may be formed integrally with the fourteenth channel plate 54. In this case, the pressure chamber 28 is formed hollowed out from a lower surface of the fourteenth channel plate 54 in the laminating direction. A portion further to the upper side than the pressure chamber 28, of this fourteenth channel plate 54 functions as the vibrating plate 55.

The piezoelectric element 60 includes a common electrode 61, a piezoelectric layer 62, and an individual electrode 63, which are disposed in this order. The common electrode 61 covers an entire surface of the vibrating plate 55. An insulating film 56 is disposed between the common electrode 61 and the vibrating plate 55. The piezoelectric layer 62 covers an entire surface of the vibrating plate 55. The insulating film 56 and the common electrode 61 are disposed between the piezoelectric layer 62 and the vibrating plate 55. The individual electrode 63, which is provided to each pressure chamber 28, is disposed on the piezoelectric layer 62. In this case, one of the individual electrodes 63, the common electrode 61, and a portion sandwiched by the one of the individual electrodes 63 and the common electrode 61, of the piezoelectric layer 62 configure one piezoelectric element 60.

The individual electrode 63 is electrically connected to a driver IC. This driver IC receives a control signal from an unillustrated controller, whereupon the driver IC generates a drive signal and applies the generated drive signal to the individual electrode 63. In contrast, the common electrode 61 is always held at ground potential.

An active portion of the piezoelectric element 62 expands and contracts in a planar direction along with the individual electrode 63 and the common electrode 61 according to the drive signal. In response, the vibrating plate 55 cooperatively deforms and changes volume of the pressure chamber 28 in an increasing/reducing direction. As a result, a discharge pressure that liquid is discharged from the nozzle 21 is imparted to said pressure chamber 28 depending on volume of the pressure chamber 28.

<Flow of Liquid>

Flow of liquid in the liquid discharge head 20 of the present embodiment will be described. The supply port 22*a* is connected to the tank 12 by supply piping, and the unillustrated return port is connected to the tank 12 by return piping. In such a configuration, when a pump of the supply piping and a negative pressure pump of the return piping are driven, liquid flows into the supply manifold 22 via the supply port 22*a* from the tank 12.

During this period, some of the liquid flows into the individual channel 64. The liquid flows from the supply manifold 22 into the supply throttling path 26 via the first communicating hole 25, and flows from the supply throttling path 26 into the pressure chamber 28 via the second communicating hole 27. Then, the liquid flows in the laminating direction along the descender 29 from its upper end to its lower end, and passes through the interposing channel 80 to flow into the nozzle 21. Then, when the discharge pressure is imparted to the pressure chamber 28 by the piezoelectric element 60, the liquid is discharged from the nozzle 21.

Some of the liquid that has not been discharged from the nozzle 21 flows along the return throttling path 31 via the interposing channel 80, and flows into the return manifold 23 via the third communicating hole 32. Then, the liquid that has flowed into the return manifold 23 via the third communicating hole 32 flows along an inside of the return manifold 23 to circulate returning to the supply port 22*a* from the return port via a sub-tank provided within the liquid discharge head 20.

<Details of Interposing Channel and Return Throttling Path>

Figure 3B:
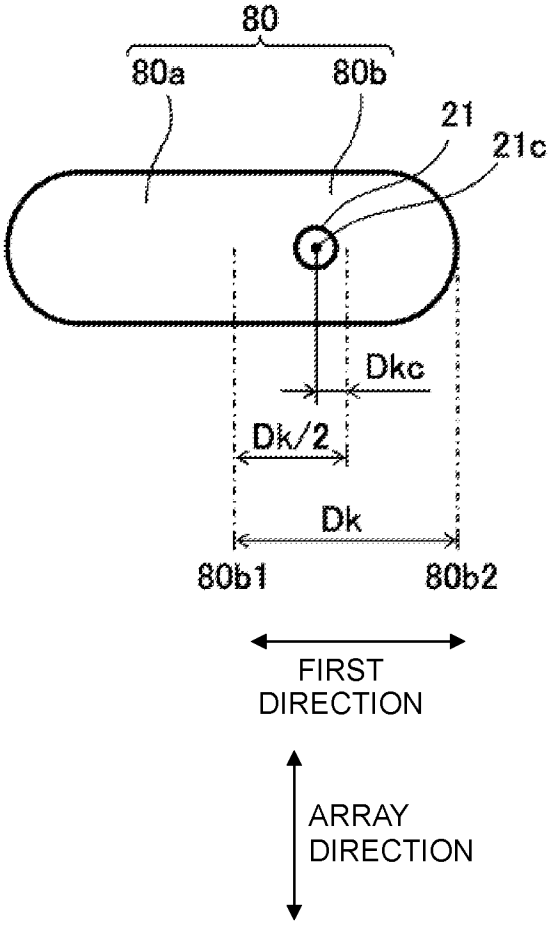
FIG. 3B depicts an enlarged plan view of the interposing channel of FIG. 3A.
Figure 3A:
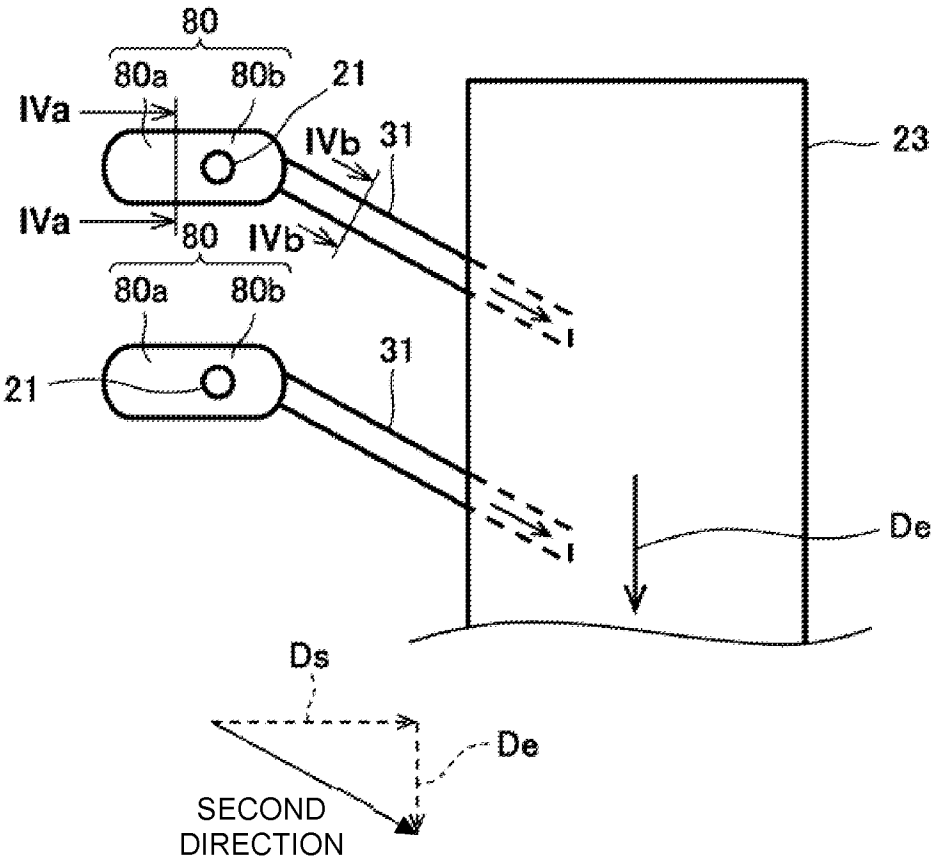
FIG. 3A depicts a plan view showing an interposing channel, a return throttling path, and a return manifold.

As depicted in FIG. 3A, in the present embodiment, the return throttling path 31 extends in a second direction differing from a first direction being a direction that the interposing channel 80 extends. The first direction is the same direction as the above-mentioned width direction. Moreover, a vector associated with the second direction includes a direction component Ds in the same direction as the above-described first direction and a direction component De in the same direction as a direction De that the liquid flows in the return manifold 23. In other words, in the present embodiment, the second direction is a direction inclining toward the downstream end of the return manifold 23 with respect to the first direction in planar view.

The interposing channel 80 includes: a first portion 80*a* overlapping the descender 29 in planar view; and the second portion 80*b* not overlapping said descender 29 in planar view. In the present embodiment, volume of the first portion 80*a* of the interposing channel 80 is larger than volume of the second portion 80*b* of the interposing channel 80. However, the present disclosure is not limited to this, and volume of the second portion 80*b* may be larger than volume of the first portion 80*a*. The interposing channel 80 includes a shape having a long side and a short side. The interposing channel 80 is formed in an elliptical shape in planar view, for example. The return throttling path 31 is connected to a short side (a side of the short side on a return manifold 23 side) of the interposing channel 80. In such a configuration, each nozzle 21 is disposed so as to overlap the second portion 80*b* of the interposing channel 80 in planar view. As depicted in FIG. 3B, each nozzle 21 is disposed closer to the first portion 80*a* than a center in the first direction of the second portion 80*b* of the interposing channel 80. Note that when a distance from an upstream end 80*b*1 to a downstream end 80*b*2 of the second portion 80*b* is assumed to be a distance Dk (for example, 100 μm), a distance from the center in the first direction of the second portion 80*b* to the upstream end 80*b*1 (or downstream end 80*b*2) of the second portion 80*b* will be Dk/2 (for example, 50 μm). In the present embodiment, each nozzle 21 is disposed closer to the first portion 80*a* than the center in the first direction of the second portion 80*b* in such a manner that a distance Dkc between the center in the first direction of the second portion 80*b* and a center 21*c* of said nozzle 21 will be 20 μm, for example.

Figure 4A:
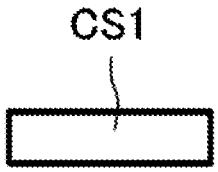
FIG. 4A depicts a view showing a channel cross section of the interposing channel.
Figure 4B:
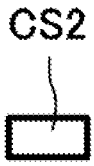
FIG. 4B depicts a view showing a channel cross section of the return throttling path.

In the present embodiment, a cross-sectional area CS2 of the return throttling path 31 depicted in FIG. 4B is smaller than a cross-sectional area CS1 of the interposing channel 80 depicted in FIG. 4A. Moreover, a depth Dh2 of the return throttling path 31 depicted in FIG. 2 is smaller than a plate thickness Dh1 of the first channel plate 41 forming said return throttling path 31.

Figure 5:
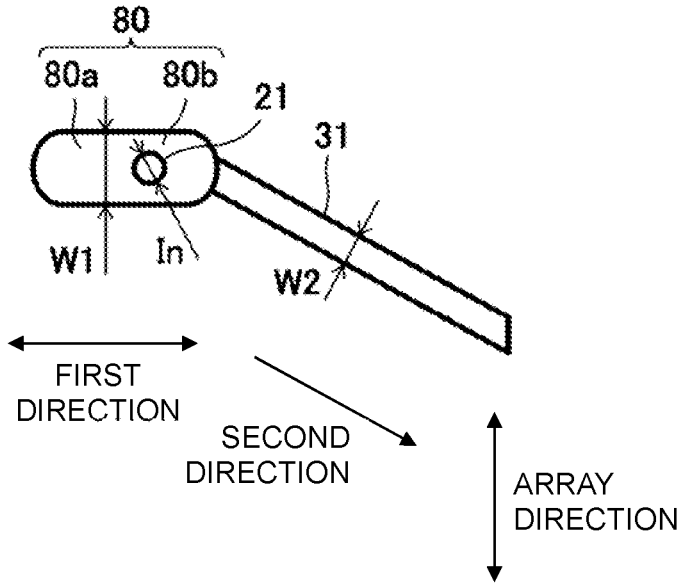
FIG. 5 depicts a view for explaining dimensions of the interposing channel, a nozzle, and the return throttling path.

Moreover, as depicted in FIG. 5, a dimension (a width) W1 in the line direction, of the interposing channel 80 (for example, 100 to 200 μm) is larger than an inner diameter In of the nozzle 21 (for example, 50 to 60 μm). Moreover, a dimension (a width) W2 in a direction perpendicular to the second direction, of the return throttling path 31 (for example, 80 to 90 μm) is larger than the inner diameter In of the nozzle 21.

Furthermore, the dimension W1 in the line direction, of the interposing channel 80 is larger than a depth of the interposing channel 80 (in other words, the plate thickness of the first channel plate 41) Dh1 (for example, 50 μm) depicted in FIG. 2. Moreover, the dimension W2 in the direction perpendicular to the second direction, of the return throttling path 31 is larger than the depth Dh2 of the return throttling path 31 depicted in FIG. 2.

As described above, the liquid discharge head 20 of the present embodiment results in that, due to the return throttling path 31 extending in the second direction differing from the first direction, a longer length of said return throttling path 31 is able to be secured than in a conventional mode where the return throttling path 31 extends in the same direction as an extension direction of the interposing channel 80. Moreover, due to the liquid discharge head 20 of the present embodiment, a bending loss can be generated in a connecting portion of the interposing channel 80 and the return throttling path 31. Furthermore, in the present embodiment, the cross-sectional area CS2 of the return throttling path 31 is smaller than the cross-sectional area CS1 of the interposing channel 80. The above result in a required pressure loss becoming more easily secured.

Moreover, in the present embodiment, the vector associated with the second direction being the extension direction of the return throttling path 31 includes the direction component Ds in the same direction as the first direction and the direction component De in the same direction as the direction De that the liquid flows in the return manifold 23. In other words, the second direction is a direction inclining toward the downstream end of the return manifold 23 with respect to the first direction in planar view. As a result, the liquid can be let flow smoothly at an outlet of the return throttling path 31.

Moreover, in the present embodiment, each nozzle 21 is disposed so as to overlap the second portion 80*b* of the interposing channel 80 in planar view. Furthermore, when the distance from the upstream end 80*b*1 to the downstream end 80*b*2 of said second portion 80*b* is Dk, a position where a distance from the upstream end 80*b*1 of said second portion 80*b* is a half-value Dk/2 of Dk will be called the center of the second portion 80*b*. At this time, each nozzle 21 is disposed closer to the first portion 80*a* than the center of the second portion 80*b*. In this regard, there is a problem that if flow rate becomes large, then a difference w-ill occur in current speeds within the nozzle 21 due to bending of flow at an inlet of the return throttling path 31, and shape of the meniscus will cease to be uniform. Accordingly, by disposing the nozzle 21 separated as far as possible from the return throttling path 31, the above-described problem can be prevented from occurring.

Moreover, in the present embodiment, inertance of the nozzle 21 with respect to the liquid is smaller than inertance of the return throttling path 31 with respect to the liquid. This makes it possible to avoid discharge energy falling.

Moreover, in the present embodiment, the dimension W1 in the line direction of the interposing channel 80 is larger than the inner diameter In of the nozzle 21. Moreover, the dimension W2 in the direction perpendicular to the second direction of the return throttling path 31 is larger than the inner diameter In of the nozzle 21. In this regard, there is a problem that if a configuration is adopted where the nozzle 21 is shifted in a return throttling path 31 direction, and an inner side of the nozzle 21 ends up being under said return throttling path 31, for example, then the shape of the meniscus when said meniscus is pulled during discharge will cease to be symmetrical. Due to the present configuration, it is difficult for the above-described problem to occur, even when there has been an affixing misalignment with respect to the first channel plate 41 of the nozzle plate 40 where the nozzle 21 is formed.

Moreover, in the present embodiment, the dimension W1 in the line direction of the interposing channel 80 is larger than the depth Dh1 of said interposing channel 80. Moreover, the dimension W2 in the direction perpendicular to the second direction of the return throttling path 31 is larger than the depth Dh2 of said return throttling path 31. As a result, it is easier for the interposing channel 80 and the return throttling path 31 to be formed, compared to when each dimension of said interposing channel 80 and return throttling path 31 is smaller than their depths.

Moreover, in the present embodiment, the return throttling path 31 is connected to the short side of the interposing channel 80. As a result, flow of liquid from the interposing channel 80 can be smoothly transmitted to the return throttling path 31.

Furthermore, in the present embodiment, the depth Dh2 of the return throttling path 31 is smaller than the plate thickness Dh1 of the first channel plate 41 forming said return throttling path 31. In this case, by the return throttling path 31 being formed in a lower half portion in a plate thickness direction of the first channel plate 41 by half-etching, it becomes possible for the downstream end of said return throttling path 31 to be formed extended upwardly to a lower portion of the return manifold 23. As a result, the channel length of the return throttling path 31 can be lengthened, hence a larger pressure loss can be secured.

MODIFIED EMBODIMENTS

The present disclosure is not limited to the above-mentioned embodiment, and may be variously modified in a range not departing from the spirit of the present disclosure. For example, it may be modified as follows.

Figure 6:
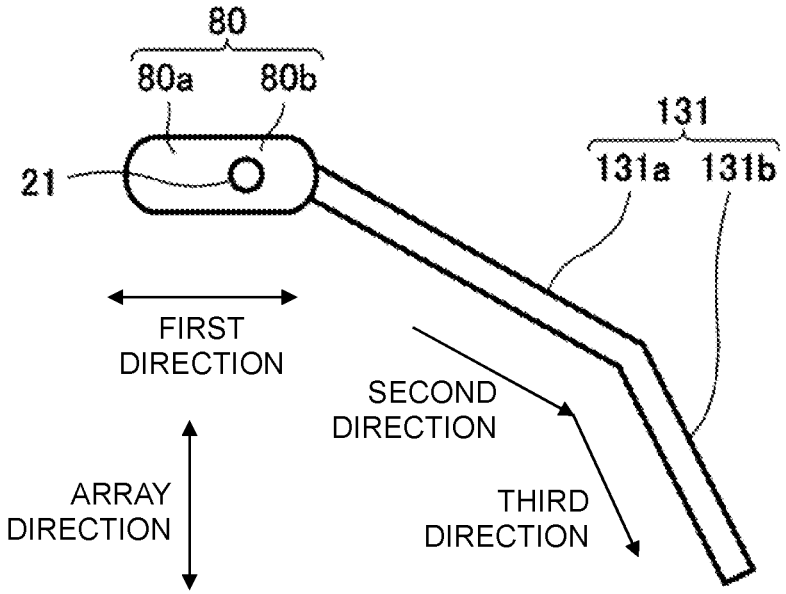
FIG. 6 depicts a plan view showing another aspect of the return throttling path.

In the above-described embodiment, a linearly formed return throttling path 31 was described. However, the shape of the return throttling path 31 is not limited to this, and the return throttling path 31 may be formed as follows. FIG. 6 is a plan view showing a return throttling path 131 according to a modified form. As depicted in FIG. 6, the return throttling path 131 may be bent. In detail, the return throttling path 131 includes: a first portion 131*a* extending in the same direction as the second direction that the return throttling path 31 in the above-described embodiment extends; and a second portion 131*b* connected to said first portion 131*a* and extending in a third direction. The third direction is a direction inclining more than the second direction does toward the downstream end of the return manifold 23 with respect to the first direction in planar view. By the return throttling path 131 being bent in this way, a larger pressure loss can be secured. Note that although in FIG. 6, the return throttling path 131 has been configured to have one bending point, there is no such limitation, and there may be adopted a return throttling path having two or more bending points.

Moreover, in the above-described embodiment, a configuration was adopted where each nozzle 21 is disposed so as to overlap the second portion 80*b* of the interposing channel 80 in planar view, and is disposed closer to the first portion 80*a* with reference to the half-value Dk/2 of the distance Dk from the upstream end 80*b*1 to the downstream end 80*b*2 of said second portion 80*b*. However, the above-described embodiment is not limited to this, and each nozzle 21 may be disposed closer to the second portion 80*b*.

Furthermore, in the above-described embodiment, a configuration was adopted where the return throttling path 31 is formed in the lower half portion in the plate thickness direction of the first channel plate 41 by half-etching. However, the above-described embodiment is not limited to this, and the return throttling path 31 may be formed in an entirety in the plate thickness direction of the first channel plate 41.

What is claimed is:

1. A liquid discharge head comprising:

a channel-forming body including a nozzle surface in which a plurality of nozzles is aligned in an array direction, the channel-forming body including:

a supply manifold configured that a liquid is supplied from outside;

a return manifold configured that the liquid is discharged to outside; and a plurality of individual channels, upstream ends of the plurality of individual channels being communicated with the supply manifold, downstream ends of the plurality of individual channels being communicated with the return manifold, and the plurality of individual channels being communicated with the plurality of nozzles, respectively, wherein each of the plurality of individual channels includes: a pressure chamber, a descender being communicated with the pressure chamber, a return throttling path being communicated with the return manifold, and an interposing channel interposing between the return throttling path and descender and being communicated with the nozzle, wherein the interposing channel includes a first portion overlapping the descender and a second portion not overlapping the descender, in an orthogonal direction orthogonal to the nozzle surface, wherein the return throttling path extends in a second direction different from a first direction in which the interposing channel extends, the first portion and the second portion being aligned side by side in the first direction, and wherein a cross-sectional area of the return throttling path is smaller than a cross-sectional area of the interposing channel.

2. The liquid discharge head according to claim 1, wherein the second direction includes a direction component of a vector associated with a direction that the liquid flows in the return manifold.

3. The liquid discharge head according to claim 1, wherein each of the nozzles is disposed so as to overlap the second portion in the orthogonal direction, and is disposed closer to the first portion than a center position where a distance from an upstream end of the second portion becomes a half-value of a distance from the upstream end to a downstream end of the second portion.

4. The liquid discharge head according to claim 1, wherein an inertance of each of the nozzles with respect to the liquid is smaller than in inertance of the return throttling path with respect to the liquid.

5. The liquid discharge head according to claim 1, wherein a dimension, of the interposing channel, in the array direction is larger than an inner diameter of each of the nozzles, and a dimension, of the return throttling path, in a direction perpendicular to the second direction is larger than the inner diameter of each of the nozzles.

6. The liquid discharge head according to claim 1, wherein the return throttling path is bent.

7. The liquid discharge head according to claim 1, wherein a dimension, of the interposing channel, in the array direction is larger than a depth of the interposing channel, and a dimension, of the return throttling path, in a direction perpendicular to the second direction is larger than a depth of the return throttling path.

8. The liquid discharge head according to claim 1, wherein the interposing channel has a shape including a long side and a short side, and the return throttling path is connected to a short side of the interposing channel.

9. The liquid discharge head according to claim 1, wherein a depth of the return throttling path is smaller than a plate thickness of an etching plate forming the return throttling path.

* * * * *